350-336 SR
PM012 XR 4,067,185

United States Patent [19]
Huguenin

[11] 4,067,185
[45] Jan. 10, 1978

[54] TIMEPIECE

[75] Inventor: Freddy Huguenin, Lausanne, Switzerland

[73] Assignee: Ebauches S.A., Neuchatel, Switzerland

[21] Appl. No.: 607,232

[22] Filed: Aug. 25, 1975

[30] Foreign Application Priority Data

Sept. 23, 1974 Switzerland ..... 12836/74

[51] Int. Cl.² ..... G04B 19/34
[52] U.S. Cl. ..... 58/50 R; 340/336; 58/4 A
[58] Field of Search ..... 58/4 A, 23 R, 50 R, 58/85.5; 340/336

[56] References Cited

U.S. PATENT DOCUMENTS

| | | | |
|---|---|---|---|
| 3,738,099 | 6/1973 | Tanaka | 58/4 A X |
| 3,772,874 | 11/1973 | Lefkowitz | 58/50 R |
| 3,796,037 | 3/1974 | Fujita | 58/4 A |
| 3,797,222 | 3/1974 | Kato | 58/4 A |
| 3,889,458 | 6/1975 | Kashio | 58/4 A |
| 3,945,190 | 3/1976 | Kimura et al. | 58/50 R X |
| 3,971,012 | 7/1976 | Morokawa et al. | 340/336 |

*Primary Examiner*—Ulysses Weldon
*Attorney, Agent, or Firm*—Silverman & Cass, Ltd.

[57] ABSTRACT

A timepiece having seven aligned signs for representing the month of the year, the day of the week, and morning or evening of the day. The center one of the seven signs is configured differently than the other six signs to indicate a special day of the week. Each sign has electro-optic display means to indicate the particular day of the week.

4 Claims, 1 Drawing Figure

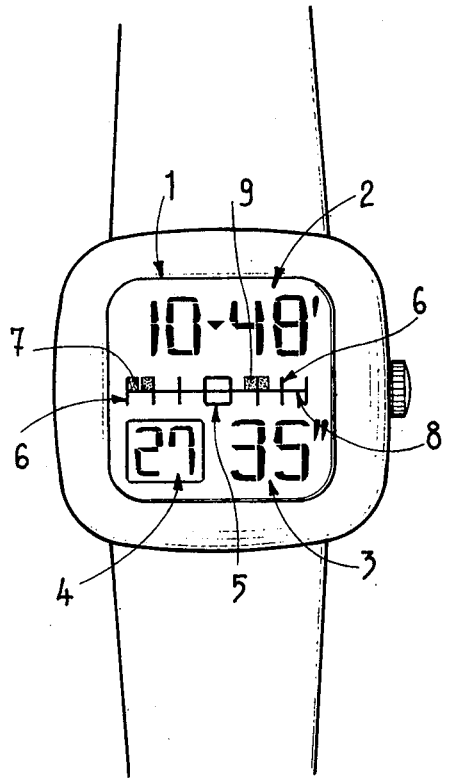
1
9
2
10-48'
6
7
6
27
35"
8
4
5
3

TIMEPIECE

The present invention relates to a timepiece comprising a device indicating the days of the week.

This timepiece is characterized by the fact that this device comprises a main sign representing a remarkable day of the week, provided with two groups of three signs each, situated on both sides of the main sign, and which represent, at least indirectly, respectively the three days of the week preceding the remarkable day and the three days which follow it, the said device comprising moreover means putting in evidence anyone of the said signs or of the spaces comprised between the said signs so as to designate one day of the week.

The drawing shows, by way of example, one embodiment of the object of the invention.

The sole FIGURE is a plan view of a calendar wristwatch having an indicator of the days of the week.

The watch represented has a digital display device comprising means 1 for displaying the hour, means 2 for displaying the minutes and means 3 for displaying the seconds. It comprises also means 4 for displaying the days. All these display means are electro-optic, for instance with liquid crystals, and comprise segments which are selectively made visible.

The watch represented comprises moreover a device indicating the days of the week comprising a sign 5, situated in the center of the dial, on both sides of which are arranged two groups of three signs 6 constituted each by a vertical line. The sign 5, which is the main sign, represents Sunday. It has the shape of a square so that it has a dimension in the direction in which are alined the six signs 6.

The device indicating the days of the week comprises electro-optic means, including for instance electroluminescent diodes or liquid crystals, producing a contrasted zone such as the spot indicated at 7 in the drawing, which can be inside the square constituting the sign 5 or in the spaces situated between two successive signs 6 or still between the sign 5 and one or the other of the signs 6 which are adjacent thereto. The means producing the displacements of the indicating spot 7 have not been represented, being out of the scope of the invention and being known per se.

The indication of Sunday is provided by putting in evidence the sign 5, the indication of the three days which precede Sunday by putting in evidence the three spaces preceding this sign 5 and the indication of the three days which follow Sunday by putting in evidence the three spaces following the sign 5.

The day indicated by the sign 5 could be different from Sunday but be any other remarkable day such as the Sabbath-day, for instance, or also a private or personal remarkable day, such as a weekly free day, for instance.

As a modification, the electro-optic device could make visible the signs 6 themselves and not the spaces comprised between them or between them and the sign 5.

An horizontal line 8 divides in two portions the sign 5 and the several signs 6. The electro-optic device is arranged so that the indicating spot 7 be situated above this line ante meridian and underneath post meridian, so as to indicate if one is in the morning or in the evening.

Owing to this division in two portions produced by the line 8, the six signs 6 form twelve half-signs, that permits to an electro-optic device producing an indicating spot 9 coming opposite one or the other of the said 12 half-signs to indicate the months of the year.

As a modification, the several signs 5 and 6 could be arranged vertically, and not horizontally as disclosed and represented, in which case the lines 6 will be horizontal and the line 8 vertical.

What I claim is:

1. A display for a timepiece adapted to be driven, including a plurality of separate indicia other than numerical or letter characters on said timepiece aligned with each other along a common line, and indicating means for visually identifying selected indicia corresponding to days of the week, the improvement residing in formation of one of the separate indicia of a configuration geometrically different and distinct from the other of the separate indicia, said other of the separate indicia being spatially disposed in zones located in symmetrical relation to said one of the separate indicia.

2. The combination of claim 1 wherein said other of said indicia are formed by a plurality of line segments intersecting said common line in spaced relation to each other to define said zones as weekday identifying areas therebetween, said indicating means including spot means visually activated at a selected one of said weekday identifying zones or said one of the separate indicia.

3. A display for a timepiece as claimed in claim 2 wherein:

said one of the separate indicia has a substantially rectangular configuration.

4. The display as claimed in claim 2 wherein: each of said weekday identifying zones includes an ante meridian indicating portion and a post meridian indicating portion on opposite sides of said common line.

* * * * *